US005527223A

United States Patent [19]

Kitchen et al.

[11] Patent Number: 5,527,223

[45] Date of Patent: Jun. 18, 1996

[54] SWING TYPE AMUSEMENT RIDE

[76] Inventors: William J. Kitchen, 10385 Sailor Ct., Longmont, Colo. 80305; Kenneth G. Bird, P.O. Box 90265, Casper, Wyo. 82609

[21] Appl. No.: 266,200

[22] Filed: Jun. 27, 1994

Related U.S. Application Data

[63] Continuation-in-part of Ser. No. 184,923, Jan. 24, 1994, abandoned.

[51] Int. Cl.[6] ..... A63G 9/00

[52] U.S. Cl. ..... 472/118; 472/131; 472/133

[58] Field of Search ..... 472/49, 116, 118, 472/80, 131, 133, 137

[56] References Cited

U.S. PATENT DOCUMENTS

| | | |
|---|---|---|
| 1,229,519 | 6/1917 | Rach . |
| 2,311,171 | 2/1943 | Hawthorne . |
| 2,779,596 | 1/1957 | Ridgway . |
| 3,476,385 | 10/1969 | Foy . |
| 3,701,528 | 10/1972 | Ryan . |
| 3,885,503 | 4/1974 | Barber . |
| 4,978,120 | 12/1990 | Greenwood . |
| 5,094,448 | 3/1992 | Hackett . |
| 5,203,744 | 4/1993 | Checketts . |
| 5,267,906 | 12/1993 | Kitchen et al. . |

*Primary Examiner*—Carl D. Friedman
*Assistant Examiner*—Beth Aubrey
*Attorney, Agent, or Firm*—Rick Martin

[57] ABSTRACT

The ride (10) is capable of raising a rider (22) to a height of ten meters or more above the ground, and then releasing the rider to swing. It includes a support structure (12), a support line (16) secured to the support structure at one end, with an opposed end secured to a rider, preferably to an attachment which is worn by a rider (20). A launch structure (26) is spaced from the support structure (12) and carries a launch line (24) which has an end (48) which is capable of being raised and lowered above the ground, and which is designed to be releasably attached to a rider attachment, so as to lift a rider from the ground. In operation the rider attachment with the support line attached is secured to the rider, the launch line is releasably secured to the attachment, and the launch line is activated to move the rider laterally and upwardly towards the top of the launch structure. When the launch line is released from the attachment which carries the rider, the rider swings downwardly at a high speed simulating the sensation of "body flight" in a pendulum like motion. A skysaucer embodiment features a conveying vehicle which nominally holds sixty riders who simultaneously experience the body flight ride.

16 Claims, 6 Drawing Sheets

SWING TYPE AMUSEMENT RIDE

CROSS-REFERENCES TO RELATED APPLICATIONS

U.S. Pat. No. 5,267,906, issued Dec. 7, 1993 to Kitchen et al. is herein incorporated by reference. This is a continuation in part (C.I.P.) of U.S. application Ser. No. 08/184,923 filed Jan. 24, 1994, now abandoned.

FIELD OF THE INVENTION

This invention is a swing type amusement ride which includes a support structure, a launch structure, and a mechanism capable of raising a rider to a position at least ten meters above the ground, from which position the rider can swing away from the launch structure in a curved trajectory under the support structure. A sky saucer embodiment can carry dozens of riders simultaneously.

DESCRIPTION OF THE RELATED ART

Heretofore, there have been a variety of different types of amusement rides and apparatus for simulating the reduction of gravity to a rider. Some of these devices are known to be disclosed in Fitch U.S. Pat. No. 857,338; Ridgway U.S. Pat. No. 2,779,596; Ryan U.S. Pat. No. 3,701,528; and Greenwood U.S. Pat. No. 4,978,120.

Furthermore, there have been a variety of playground and backyard swings and swing sets used by children and adults. These swings can vary in height from a small swing standing about three meters high, to a large swing standing about five meters high. A rider of such a swing normally takes a sitting position in a swing seat and starts its pendulum motion from a position in which the swing is vertical, unless aided by a running start, or by a person to help push and enhance the height of the swing arc. While the sitting or standing position on a swing seat is the norm, riders have been know to lie on their stomachs on top of a swing seat and swing in a prone position, but without being secured to the swing.

Even the most skillful and powerful swing rider on a large swing will rarely exceed a 2 o'clock or 10 o'clock position at a height of about seven meters, before gravity overtakes the centrifugal force of the swing, and slack occurs in the swing rope or chain. Should a rider manage to force the swing to make a 360 degree circuit, his or her height would seldom exceed about ten meters from the ground.

The use of external equipment to assist a swing rider to begin his or her ride from an elevated position is taught in Hoppes U.S. Pat. No. 1,731,532; Pruessner U.S. Pat. No. 1,918,559; and Walker U.S. Pat. No. 3,140,870. Each of these references disclose standard playground and backyard type swing systems which have adjacent stairs which a person may climb to start swinging from a position above the ground, and thereby obtain an immediate swing elevation and experience an initial speed which is higher and faster than starting to swing from the ground. But, even in these systems the initial height above the ground which the rider experiences would seldom be more than about one to four meters.

In some swing systems, and especially those designed for small children, and in some amusement rides, bungee jumping equipment, parachute equipment, hang gliding systems, and the like mechanisms for securing a rider to the equipment is provided. But, none of these systems provide a swing ride which initiates a swing release at a height of more than ten meters above the ground. The prior art swing sets have not been large enough, strong enough or high enough to justify the use of a body harness for holding an adult rider, and especially not for holding and securing such a rider in a prone position, such as in a hang glider. Furthermore, prior art swing technology has not been know to operate at heights which allow a rider to reach a height which is greater than about seven to ten meters above the ground, or, other than in a trapeze system, to swing from a "launch" structure towards a "support" structure. It is noted that in trapeze systems, the swings are intentionally "high above the center ring", and never approach the ground.

It is thus seen that nowhere in the prior art is there a swing type amusement ride which includes, in combination, a support structure having an upper portion which is located ten meters (and as much as several hundred meters or more) above the surface of the ground, a support line having an upper end connected to the upper portion of the support structure and a lower end to which is connected a system for securing a rider to the support line. Further included is a launch structure which as an upper portion which is located ten meters (and as much as several hundred meters more) or more above the surface of the ground. The launch structure is spaced from the upper portion of the support structure, and carries a launch line which includes a launching mechanism for releasable attachment to the rider securing mechanism. Further included is a mechanism associated with the launch structure, but which is not powered by the rider, for raising a rider who has been secured to the system to a height of at least ten meters (and as much as several hundred meters or more) above the ground, from which height the rider may begin his or her swing away from the launch structure towards the ground in a curved trajectory to simulate the feeling of "body flight". Further novelty is taught by a skysaucer vehicle embodiment which can carry several dozen riders simultaneously.

SUMMARY OF THE INVENTION

It is, therefore, an object of the present invention to provide a rider of the subject amusement ride with a sensation of "body flight", and an overall feeling similar to that of swooping along the ground in a hang glider, or of skydiving.

Another object of the present invention is to provide the thrills and excitement of bungee jumping, but without the dangers related to the use of rubber or elastic cords, without the possibility of failing to make harness connections to the cord or support line, and without subjecting the body of the rider to the type of stress borne by a bungee jumper, and without the natural fear of a "free fall" plunge associated with bungee jumping.

Yet another object of the present invention is to provide an amusement ride which can be enjoyed by a single rider secured in a single harness, or by a plurality of riders who may enjoy the thrill of riding together while secured in tandem harnesses.

Yet a further object of the present invention is to furnish an amusement ride which provides smooth, fast acceleration, excitement and thrills, while being a fail safe ride, without the anxiety and trauma related to finding the nerve to jump from an elevated platform in a "free fall" plunge, such as that which is associated with bungee jumping and sky diving.

Another object of the present invention is to provide a high altitude amusement ride which has a low injury potential for its operators by allowing the operators of the ride to remain on the ground, as opposed to having to work aloft at high altitudes and at risk, as with bungee jumping and sky diving operations.

Another object of the present invention is to provide a swing type amusement ride in which the rider swings back and forth in a pendulum like motion about twenty times or more before terminating the ride.

Another object of the skysaucer embodiment is to provide a means for safely allowing many riders to enjoy the ride together, thus providing a more secure feeling to each rider than the single rider embodiment.

Another object of the skysaucer ride is to provide a faster and more elevated ride than the single rider embodiment.

Yet another object of the skysaucer ride is to allow more riders to be serviced in a given time than the single rider embodiment, thereby providing greater revenue to the operator.

Other objects of this invention will appear from the following description and appended claims, reference being had to the accompanying drawings forming a pan of this specification wherein like reference characters designate corresponding parts in the several views.

The present invention provides a swing type amusement ride for raising one or more riders from a position at or near a support surface aloft to a height of ten meters or more, and then releasing the rider to swing in a curved trajectory for thrill and excitement, but with little or no stress placed on the body of the rider. The amusement ride includes a support structure extending upwardly at least eleven meters above the ground (and as much as several hundred meters or more). The support structure may be a static tower, a static derrick, a static arch, a bridge, other static man-made structures, a crane, naturally occurring geological formations, and the like.

One end of a rider support line is secured to the upper portion of the support structure at a point which is at least eleven meters from the ground, while the second end of the rider support line is secured to a rider securing attachment, to which a rider can be secured during the ride, and then removed, such as a harness. In preferred embodiments, one end of a second line, which is used as a stabilization line, is also secured to the upper portion of the support structure, while the second end of the stabilization line is also secured to the harness or other attachment which secures the rider during the ride.

Disposed near the support structure is an upright launch structure having an upper portion which is spaced from the upper portion of the support structure. The launch structure may also be a static tower, a static derrick, a static arch, a bridge, other static man-made structures, a crane, naturally occurring geological formations, man made geological formations, and the like, which have an upper portion which has a height which reaches or exceeds at least eleven meters from the ground (and as much as several hundred meters or more). The upper portion of the launch structure carries a launch line which has a free end which is capable of being lowered and of being raised to a height which reaches or exceeds at least ten meters above the ground. One end of the launch line is designed to be releasably attached to the harness attachment which is releasably secured to the rider. As detailed below, the launch line is capable of raising a rider who is releasably secured to a harness or other attachment to a height of at least ten meters above the ground. The launch line is attached to the release device, preferably a quick release device. The release device, is mounted between the attachment device which carries the rider, and the launch line, preferably in a manner and in a position which allows the rider to release the launch line and begin the swing descent at will.

In operation, in preferred embodiments, the rider is initially in an upright standing position on the ground, or on a stand closely adjacent to the ground, beneath the support structure. The attachment, for example in the form of a body harness, may be secured to the rider by the ride operators at this location or prior to the ride reaching this location. The ride ground crew then attach the support and stabilization lines which are connected to and which depend from the support structure to the body harness attachment of the rider. The ground crew next attaches the launch line which depends from the launch structure to the release device mounted on the body attachment of the rider.

The ride operators then activate the launch line to retract it towards the launch structure at a controlled speed. This causes the rider to be moved laterally from beneath the support structure and towards the launch structure. If the rider is properly connected to the support and/or stabilization lines, then at this time the rider will be raised aloft from the ground, and be suspended from the support structure by the support and/or stabilization lines, and from the launch structure by the launch line. It is to be noted that, as a fail safe measure, if the rider is not properly connected to the support and/or stabilization lines then at this time the rider will be pulled laterally, but will not be immediately raised aloft from the ground, and the operation can be terminated. After the stand on which the rider initially stands is removed, or after the rider is raised aloft by the launch line, he or she is preferably rotated to a prone, face down position by the harness attachment, as detailed below. As the launch line continues to be retracted towards the launch structure at a controlled speed, the rider is raised in a curved path further and further from the ground, towards the launch structure and away from the support structure.

When the rider reaches a predetermined height, preferably ten meters or more above the ground, or when the rider activates the release, the launch line is disconnected from the rider, and the rider begins to fall in a curved trajectory which simulates the sensation of being in "body flight". The resulting sensation, including acceleration to speeds from about seventy to more than eighty kilometers per hour, is similar to hang-gliding and skydiving, including the surge of the wind and the excitement of "ground rush" while approaching and passing close over the ground and objects projecting from the ground at high speeds. The rider then continues to swing back and forth in a curved trajectory underneath the support structure until he or she slows to a speed at which the ride operators may stop and remove him or her from the harness attachment.

In preferred embodiments, the support line is made of an aircraft-quality stainless-steel cable with safety in mind, and the ride does not depend on the use of rubber and elastic bungee cords. As used herein, the "ground" may be an actual ground surface, or a man made surface such as pavement, tarmac, a concrete pad and the like. The height of the structures or of the rider from the ground may be measured with respect to the actual "ground", or to a depression below the structures, such as a river bed, ravine, valley, or the like. As used herein, the portion of the support structure to which the support line is attached, and the portion of the launch structure from which the launch line is attached will always be considered to be the "upper portion" of the structure.

In an alternative mode of operation, the rider may be lifted directly to the top of the launch structure, the harness or other attachment secured to the rider, and the support line and stabilization line secured to the harness or other attachment. Then, the rider may launch him or herself from the launch structure and experience a ride which is similar to that of the preferred embodiment. In such an operation, the support line and stabilization line will be raised to the top of the launch structure by the launch line. This alternative mode of operation will allow the support and stabilization line to have a substantial amount of slack, thus making the initial part of the ride to be vertical, rather than curved, or, by proper calculation of height an elasticity, the use of bungee support and stabilization lines.

In another alternative mode of operation, several riders are fastened to the end of the support line. Each rider wears a harness. Each harness is connected to the end of the support line. The riders can share the excitement and thrill of flying.

In another alternative mode of operation, several riders are fastened to a solid saucer structure. Four parallel support lines approximately 100 meters long secure the saucer to a support structure. The saucer is lifted with a launch line approximately 100 meters to a launch structure then released, in much the same way as the single rider embodiment. In preferred embodiments, a second set of four parallel lines are used for stabilization. The stabilization lines are arranged in a criss-cross fashion to prevent twisting and sway.

Alternatively, two support lines, or just a single support line could be used. It is preferred to use at least as many stabilization lines as support lines since the stabilization lines function also as backup safety lines for the unlikely event of support line failure.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Sky Coaster—Single Rider

Figure 1:
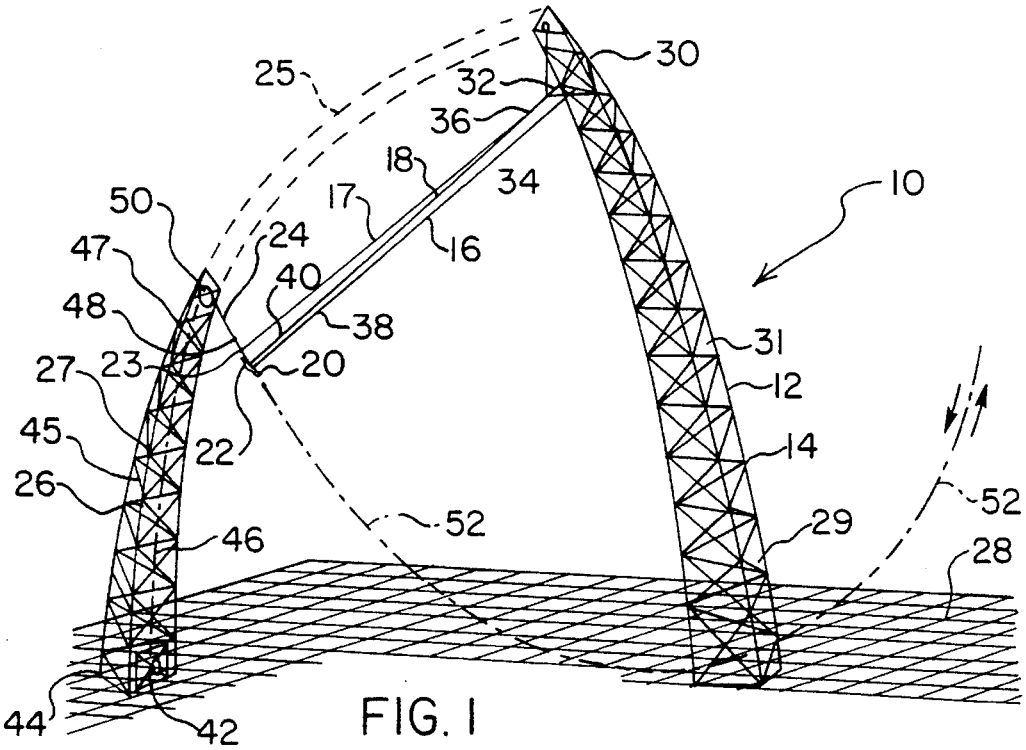
FIG. 1 is a diagrammatic perspective view illustrating the subject invention using a fixed tower, or an arch as a support structure with a single rider suspended from a support line and stabilization line, and connected to a launch line.
Figure 2:
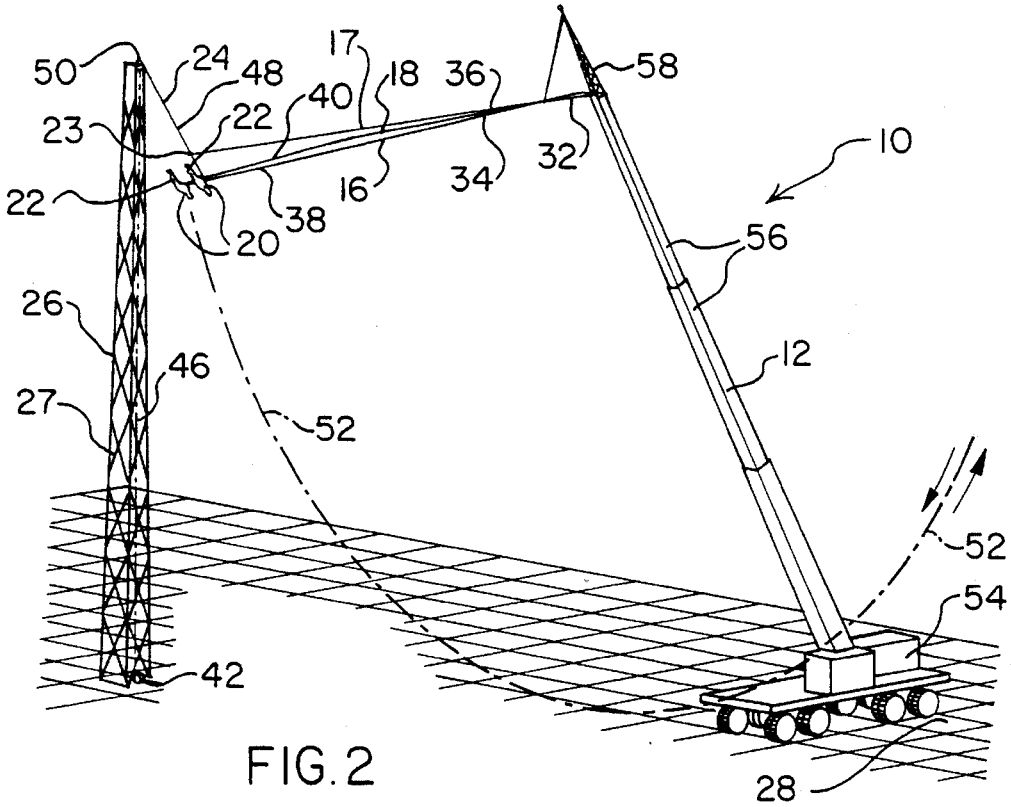
FIG. 2 is a diagrammatic perspective view illustrating the invention using a mobile crane as a support structure with a pair of tandem riders suspended from the support and stabilization lines, and connected to a launch line.

Referring to FIGS. 1 and 2, the subject swing type amusement ride is shown having general reference numeral 10, and with other like elements having like reference numbers in the different figures. In its preferred embodiment, as shown in FIG. 1, swing type amusement ride 10 includes an upright support structure 12, shown in this drawing as a static man made tower 14, a rider support line 16, a rider stabilization line 18, a launch weight line 17, and a body attachment, for example, in the form of a harness 20 (shown in greater detail in FIGS. 6 and 7). Harness 20 is secured to a portion of the body of a rider 22 during the ride, and is removed from the body of a rider 22 after the ride is completed. A launch line 24 depends from launch structure 26, which is also shown as a static tower 27. The end of the launch line which connects to the rider includes a launch weight 23. Launch line 24 may be raised and lowered from launch structure 26, as detailed below. Support structure 12 and launch structure 26 both extend upwardly from the ground 28 to a height of at least eleven meters, and to as much as several hundred meters, or more. As shown in phantom in FIG. 1, support structure 12 and launch structure 26 may be connected by a crown portion 25, shown in phantom, to form an arch.

The support structure 12 includes a lower portion 29, an upper portion 30 and a middle portion 31. As noted above, the portion of support structure 12 to which the support line is attached will always be considered to be "upper portion" 30. In preferred embodiments, as detailed in FIGS. 3 and 4, a triangle shaped support and stabilization line mechanism 32 is mounted on support portion 30 of support structure 12. An upper first end 34 of support line 16 and an upper first end 36 of stabilization line 18 are connected to support and stabilization line mechanism 32. In preferred embodiments, support line 16 and upper end 36 of stabilization line 18 are pivotally connected to support and stabilization line mechanism 32. A lower second end 38 of support line 16 and a lower second end 40 of stabilization line 18 include clasps 102 and 103 which can be used to securely couple support line 16 and stabilization line 18, respectively, to harness 20. As detailed below, after the ride is completed, the same clasps 102 and 103 are used to release support line 16 and stabilization line 18 from harness 20. In preferred embodiments, clasp 102 and 103 are locking carabiners.

Support line 16 may be cable, rope, heavy cord, a rigid pole, chain, and the like. Stabilization line 18 and launch line 24 are preferably flexible, and may also be cable, rope, heavy cord, chain, and the like. At this time 8-millimeter-diameter aircraft-quality stainless-steel cables are preferred for all of the lines. Such stainless steel cables are each rated to support four-thousand kilograms. Launch weight line 17 may be cable, rope, heavy cord, chain, and the like. At this time a 6-millimeter-diameter aircraft-quality stainless-steel cable is preferred. In operation the launch weight line holds less than 20 kilograms of weight at all times.

Two alternate embodiments (not shown) can be made from lines 16 and 18. In the first embodiment, stabilization line 18 is nominally approximately 15 centimeters longer than support line 16 and in operation is slack. In the interest of safety and redundancy, the stabilization line 18 acts as a backup safety line in the unlikely event that support line 16 should break, and vice versa. Furthermore, and as its primary reason for being used, stabilization line 18 acts to insure that support line 16 moves in a curve directly below the horizontally disposed support and stabilization line mechanism 32, which extends directly outward from the upper portion 30 of support structure 12. Also, stabilization line 18 provides for an anti-torque means for preventing the rider 22 in harness 20 from twisting during the ride. In an alternate embodiment, lines 16 and 18 have equal lengths and sustain approximately the same weight.

Launch structure 26 includes a winch 42 mounted at a lower portion 44 of launch structure 26. The operation of winch 42 will normally be controlled by a ground crew, and may be manually operated, but is preferably motor driven. Launch structure 26 also includes a middle portion 45 and an upper portion 47. Launch line 24 has a first end 46 and a second end 48 which can be releasably attached to body harness 20. The second end 48 of launch line 24 includes a launch weight 23. Launch weight 23 is also attached to launch weight line 17. Launch weight 23 weighs approximately 15 kilograms. Launch line 24 passes over pulley 50 which is rotatably mounted on the upper portion 47 of launch structure 26. The first end 46 of launch line 24 is attached to winch 42. When winch 42 is activated it serves to raise or to lower the second end 48 of launch line 24. Launch weight 23 serves to return the lower the end 48 of launch line 24 to the rider loading position when the winch 42 is activated to lower the second end 48.

In the embodiments shown in FIGS. 1 and 2, when winch 42 is activated in what would be the counter-clockwise direction in these views, and the second end 48 of launch line 24 and clasps 102 and 103 are attached to harness 20, then rider 22 is raised from a position on or near support surface 28. As noted above, as a fail safe measure, if the rider 22 is not properly connected to the support and/or stabilization lines 16 and 18 by clasps 102 and 103, then at this time the rider 22 will be pulled laterally, but will not be immediately raised aloft from the ground 28, and the operation of the ride can be terminated. As the action of winch 42 continues in the counterclockwise direction, a properly connected rider 22 will be raised to a high elevated position. As shown in FIGS. 1 and 2, riders 22 are represented as being approximately forty-five and sixty meters, respectively, above the ground.

Figure 7:
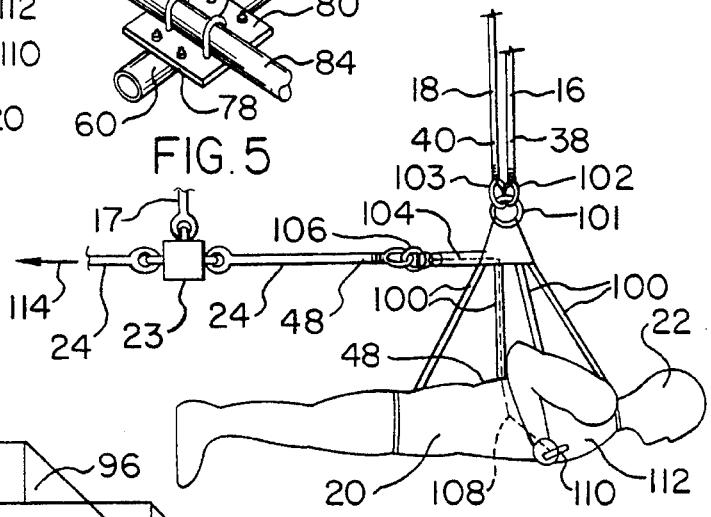
FIG. 7 is a side view of the rider of FIG. 6 in a prone position in the body harness and suspended from the support and stabilization lines and positioned for being moved aloft by a launch line.

In preferred embodiments, rider 22 can, at will, activate a quick release mechanism 106, as shown in FIG. 7, and detailed below. Release mechanism 106 is located between and is connected to both end 48 of launch line 24 and harness 20. In preferred embodiments, and as detailed below, release mechanism 106 is integral with harness 20, and the second end 48 of launch line 24 is connected to it, and is designed to be activated by rider 22. When the rider activates release mechanism 106, the second end 48 of launch line 24 is released from harness 20. This then allows rider 22 to fall and accelerate downwardly in a curved trajectory moving at speeds greater than seventy kilometers per hour at the perigee, swooping past ground surface 28, underneath and then past the upper portion 30 of support structure 12. The curve of the rider's swinging motion is shown in FIGS. 1 and 2 as dotted line 52. The rider 22 will continue to swing back and forth along curve 52 in a pendulum motion as many as twenty times, or more, until the swinging motion substantially subsides. The rider 22 can then be manually stopped and released from clasps 102 and 103, and removed from harness 20 by the ground crew.

In FIG. 2, the upright support structure 12 is shown as a mobile crane 54 having a telescoping boom 56 with an upper portion 58 which may be as much as seventy-five meters above the ground, or higher. As in FIG. 1, the upper portion 58 of crane 54 carries a support and stabilization line mechanism 32. In FIG. 2, a pair of riders 22 are shown in a tandem harness 20 just prior to release from launch line 24.

Figure 3:
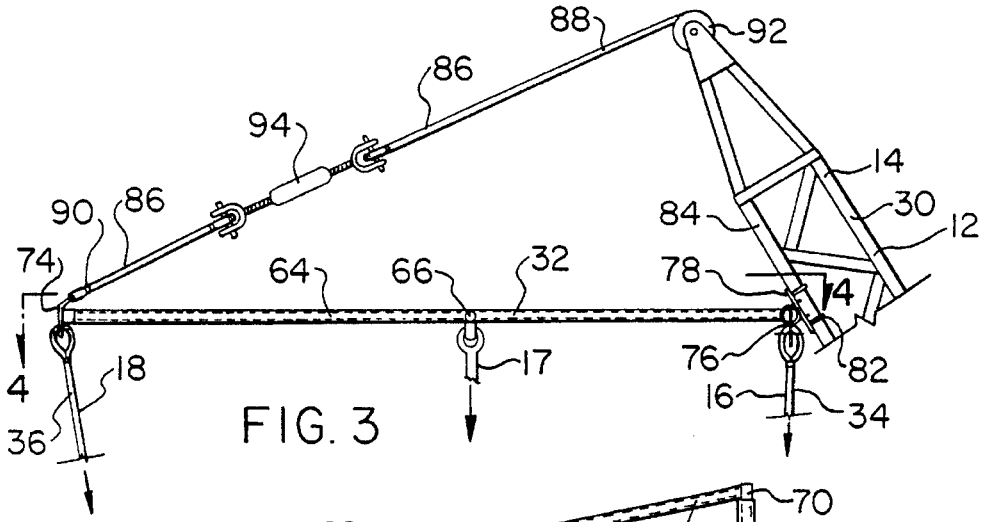
FIG. 3 is an enlarged side view of a support and stabilization line mechanism which is pivotally attached to an upper portion of the support structure.
Figure 4:
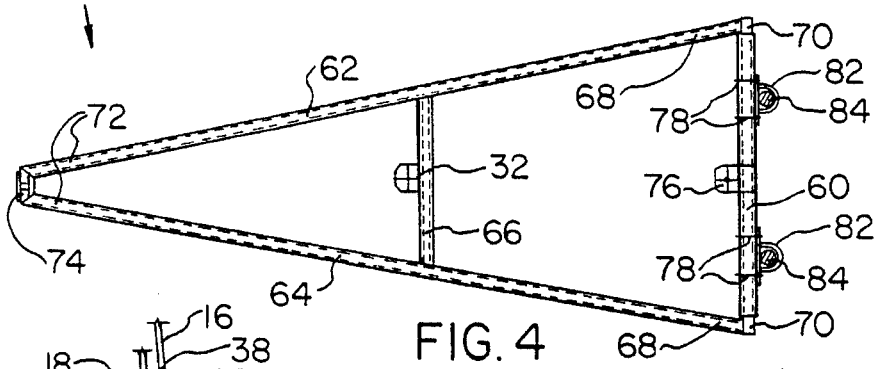
FIG. 4 is a top view of the support and stabilization line mechanism taken along lines 4—4 shown in FIG. 3.

In FIGS. 3 and 4, an enlarged side view and top view, respectively, of the support and stabilization line mechanism 32 is shown. Support and stabilization line mechanism 32 is pivotally attached to upper portion 30 of support structure 12, such as tower 14. The upper portion 30 of tower 14 is the same or similar to the upper portion 58 used with the mobile crane 54. Referring now to both FIG. 3 and 4, mechanism 32 includes a fixed horizontal cross bar 60 and a pair of lift arms 62 and 64 which together form an internal triangular configuration. Ends 68 of lift arms 62 and 64 are secured together by cross brace 66 to form a still larger triangular configuration. An internal shaft 70 is rotatably located within cross bar 60, and the ends 68 of the lift arms 62 and 64 are attached to the opposed ends of internal shaft 70. Ends 72 of lift arms 62 and 64 come together to form the apex of the triangles, and a stabilization line mounting plate 74 is secured to this apex.

Figure 5:
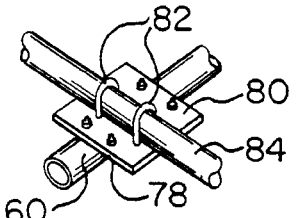
FIG. 5 is an enlarged perspective view of a mounting bracket used to secure the support and stabilization line mechanism to a portion of a metal frame of the support structure.

Cross bar 60 has a support line mounting plate 76 secured thereto and centered along the length of the cross bar 60. Cross bar 60 is secured to the upper portion 30 of the support structure 12 using, for example, a pair of "U" bolts 78 secured to a mounting bracket 80, as shown in an enlarged perspective view in FIG. 5. A second pair of "U" bolts 82 is used to secure a portion of a metal frame 84 of the support structure 12 to the mounting bracket 80. In FIG. 3, the upper first end 34 of support line 16 can be seen attached to and suspended from the support line mounting plate 76. Likewise, in FIG. 3 the upper first end 36 of stabilization line 18 can be seen attached to and suspended from stabilization line mounting plate 74. Launch weight line 17 is attached to cross brace 66.

It has been found that for smooth swinging and for fast acceleration of rider 22 after he is released from launch line 24 that support line 16 should be maintained taut during the swing so that it will normally carry the full weight of the rider 22. The stabilization line 18 is preferably connected to harness 20 with a slight amount of slack so that it does not cause deflection or deviation of rider 22 as support line 16 moves in a curved trajectory swinging the rider 22 back and forth under the support structure 12. The slack in a fixed length of stabilization line 18 can be adjusted by raising and lowering support and stabilization line mechanism 32, for example by using adjustment line 86. Adjustment line 86 has a first end 88 and a second end 90. The first end 88 of adjustment line 86 is attached to a pulley 92 which is shown mounted on top of the support structure 12. The second end 90 of adjustment line 86 is attached to the stabilization line mounting plate 74. Disposed along the length of the adjustment line 86 is a line tension adjustment mechanism, such as turnbuckle 94. By adjusting the turnbuckle 94 on the adjustment line 86, stabilization line mounting plate 74 at the apex of support and stabilization line mechanism 32 which is pivotally mounted on support structure 12 is raised or lowered. This causes stabilization line 18 to be raised or lowered without the necessity of physically altering the length of line 18, and without raising or lowering support line 16. As mentioned above, stabilization line 18 also acts as a back up safety line and prevents torque or yaw of rider 22 from occurring during flight. In an alternate embodiment (not shown), support line 16 and stabilization line 18 are the same lengths and undergo the same forces.

Figure 6:
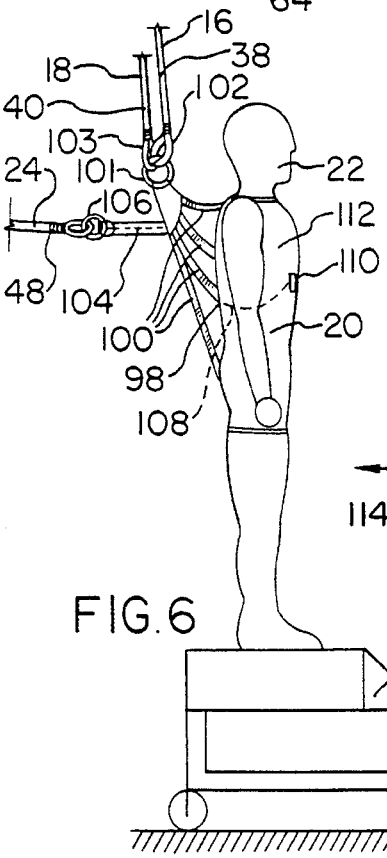
FIG. 6 is a side view showing a rider of the subject amusement ride standing on a moveable stand with a body harness received around a portion of his body.

In FIG. 6, a side view of male rider 22 is shown with the body harness 20 received and secured on his upper body. In this preferred embodiment, rider 22 is shown standing on top of a movable launch stand 96 which is shown resting on the ground 28, and underneath support structure 12. At this location, the lower second ends 38 and 40 of lines 16 and 18, respectively, are suspended vertically downward, and shown removeably coupled to support ring 101 of harness 20 by clasps 102 and 103. After the rider 22 is hoisted aloft using the launch line 24, as shown in FIGS. 1, 2, and 7, the launch stand 96 is removed from what will become the path of curve 52, and rider 22 rotates into a face down prone position due to the configuration of harness connection 20. Stand 96 is later returned to a position below rider 22 after the ride is completed in order to help the ground crew and the rider 22 remove the harness 20.

Harness 20 includes a back portion 98 having a plurality of support straps 100 which are joined together around support ring 101. The lower second ends 38 and 40 of support line 16 and stabilization line 18 are attached to support ring 101 from which the rider 22 will be suspended during the ride. The back portion 98 also includes a launch strap 104 to which a release 106, such as the 3-ring parachute type which is illustrated, is attached. Such 3-ring canopy release devices were first designed in 1976, and are a standard quick release mechanism used in the parachute industry, and are popular in the sport parachute business because it provides a 200:1 mechanical advantage. While the 3-ring release 106 is shown, it is clear that other types of quick releases can be used equally well, such as the older two-button and cable models made for the United States military by the Capewell Mfg. Co. of Hartlord, Conn., USA. Release 106 is connected to a manual launch cord 108 disposed along the side of one of the support straps 100 and terminating at a launch activation handle 110 which is shown to be located on a front portion 112 of the harness 20. During the operation of the present invention, the lower 48 of launch line 24 is connected to release 106. The rider 22, while moving upward, or when held aloft, can at will use his hand to pull activation handle 110. When activation handle 110 is pulled, this in turn releases quick release 106 from the launch line 24, and allows rider 22 to begin the falling and swinging action of the ride from a height of ten meters or more from the ground.

After winch 42, shown in FIGS. 1 and 2, has been activated the rider 22 is moved to the left, as indicated by arrow 114, and is then raised aloft using the combination of the pull from launch line 24, and the drag of a properly connected support line 16. The rider 22 in FIG. 7 has moved from a standing position, with lines 16 and 18 substantially vertical, as shown in FIG. 6, to the preferred face down prone position used during the lift and flight of the amusement ride 10. Using support structures 12 and launch structures 26 which are each eleven meters or more high, rider 22 is moved aloft ten meters or more above the ground surface 28, depending on the height of the launch structure 26 and support structure 12. The height of the structures notwithstanding, as rider 22 moves upwardly along curved trajectory 52, and as his height above ground surface 28 increases, rider 22 has the option to pull launch activation handle 110 at any time, and at any height to initiate the swinging falling cycle of the ride. This element of height and release control adds a further dimension of enjoyment to the ride, and encourages most riders to go to the highest possible height above the ground.

While not shown, launch line 24 preferably has a stop that will automatically cause winch 42 to shut down in order to prevent rider 22 from being raised too close to, or into contact with upper portion 47 of launch structure 26. Should the rider 22 be handicapped or otherwise unable to use his hands, the launch activation handle 110 can be controlled from the ground by one of the operators of the amusement ride 10 by a long line, not shown, to activate the release of the rider 22 when desired.

Sky Coaster—Elevator Instead of Winch

While the subject invention has been shown in the drawings and described above using a launch line 24 associated with a launch structure 26 to raise a rider 22, an additional embodiment of the amusement ride 10, is the use of the same structures as in FIGS. 1 and 2, wherein rider 22 is raised to an elevated position on launch structure 26. For example, the launch structure 26 may include an elevated platform, not shown, wherein the rider 22 is dressed in the body harness 20 and assumes a starting position standing on an elevated portion of launch structure 26. In this modification, the harness 20 of already elevated rider 22 is attached to the support and stabilization lines 16 and 18, substantially in the same manner as shown in FIG. 6. In this method of use, harness 20 would not require launch cord 108 or activation handle 110, since a launch line 24 and release is not used to initiate the swing.

In this alternative example, when rider 22 initiates his swing from an elevated position on launch structure 26 he will descend in a prone position and in the curved trajectory, as shown in dotted lines 52, and swing in a pendulum motion, as in the previous examples. In such an operation, the support line 16 and stabilization line 18 will be raised to the top of the launch structure for connection to harness 20 by launch line 24. This alternative mode of operation allows the support and stabilization line to have a substantial amount of slack, thus making the initial part of the ride substantially vertical. Also, by proper calculation of height and elasticity, bungee type support and stabilization lines may be used to add a bounce to the ride.

Sky Coaster—Launch Weight

Referring next to FIG. 7, a launch weight 23 and launch weight line 17 provide for the return of end 48 of the launch line 24 to prepare for the next rider in a timely manner with minimal manual intervention. In an earlier version of the present invention a person pulled the launch line down manually. In operation rider 22 pulls launch activation handle 110 to begin the ride. Launch weight 23 remains at the launch height until the rider swing height decreases. Winch 42 is then reversed, thereby lowering launch weight 23. Launch weight line 17 serves to maintain the descending path of the launch weight consistent with the path of the rider. Thus, the only manual intervention necessary is to ensure that rider 22 does not collide with the launch weight 23. It is preferred as a safety consideration to leave the launch weight stationary until the rider has stopped. Typical weights for launch weight 23 may range from two to twenty kilograms. The launch weight line 17 is slightly longer than the support line 17, so that it will not act to support the rider when the rider is hoisted to launch height but may remain taut.

Sky Coaster, Multi-rider Ring

Figure 8:
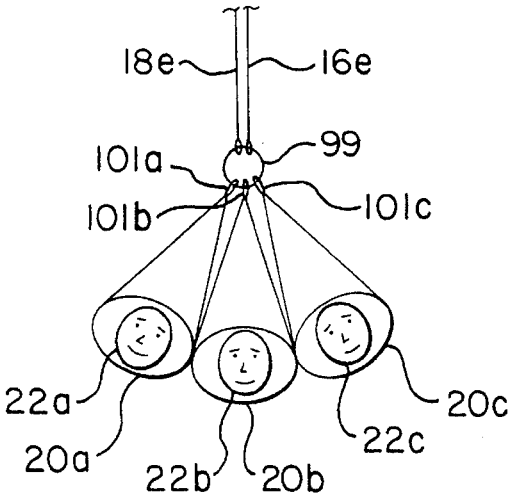
FIG. 8 is a front view of three riders in a prone position in the body harnesses and suspended from the support and stabilization lines via the multi-rider ring.

Referring next to FIG. 8 an alternate embodiment allows up to three riders to enjoy the amusement ride together. The riders 22*a*, 22*b*, and 22*c* are secured by harnesses 20*a*, 20*b*, and 20*c*, which are attached to a set of two parallel multi-rider rings 99 with support rings 101*a*, 101*b*, 101*c*. The two rings 99 are used in parallel as a safety consideration. The harnesses 20*a*, 20*b*, and 20*c* are identical to harness 20 in FIGS. 1, 2, 6, and 7. In operation, this arrangement is comfortable for one, two, or three simultaneous riders. Except for the addition of the multi-rider rings and the attachment of up to three riders instead of only one, this alternate embodiment is identical to that shown in FIGS. 1–7.

Sky Coaster, Horizontal Support Bar

Figure 9:
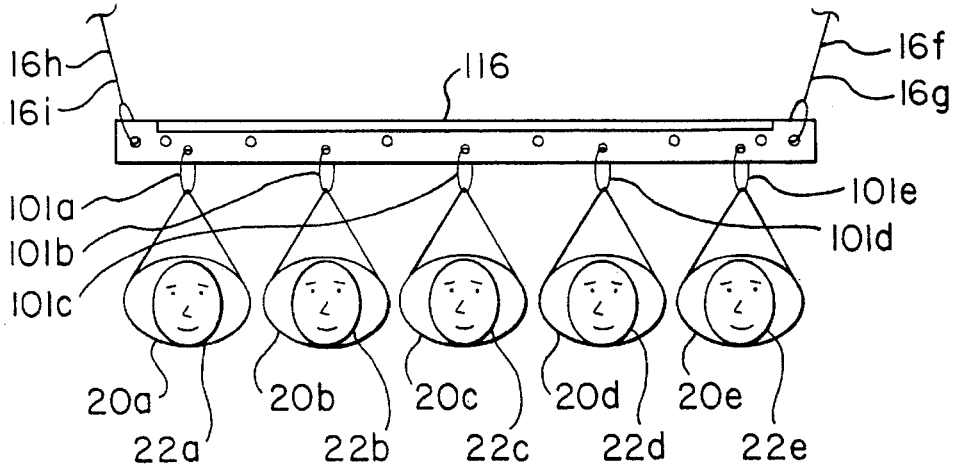
FIG. 9 is a front view of five riders in a prone position in the body harnesses and suspended from the support lines via the horizontal support bar.

Referring next to FIG. 9 an alternate embodiment allows many riders to enjoy the amusement ride together. The harnesses 20*a*, 20*b*, 20*c*, 20*d*, and 20*e* of the riders 22*a*, 22*b*, 22*c*, 22*d*, 22*e* are fastened symmetrically to a horizontal support bar 116 with support rings 101*a*, 101*b*, 101*c*, 101*d*, 101*e*. The spacing between each one of the support rings is about 60 centimeters. Four support lines 16*f*, 16*g*, 16*h*, and 16*i* are used. The support lines and stabilization lines are doubled as a safety consideration. The support bar 116 is made of two pieces of steel "L"-shaped angles bolted or riveted together in the standard fashion. Although five riders are shown, fewer could ride. A larger version of the horizontal support bar could be made to accommodate more riders.

Sky Coaster, Swivel Horizontal Support Bar

Figure 10:
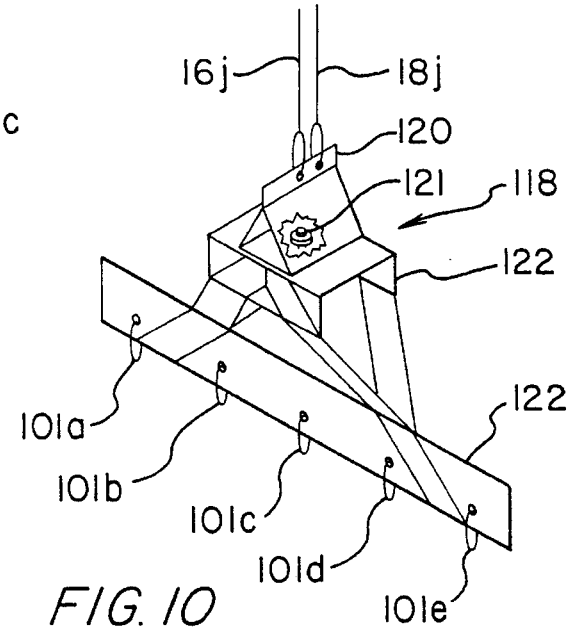
FIG. 10 is an isometric view of the swivel horizontal support bar suspended from the support and stabilization lines.

Referring next to FIG. 10 an alternate embodiment allows many riders to enjoy the amusement ride together and allows riders to swivel during the ride. Swivel horizontal support bar 118 is designed to permit axial rotation about the axis formed by lines 16*j* and 18*j*. It otherwise operates similarly to the horizontal support bar 116 in FIG. 9.

Swivel horizontal support bar 118 is comprised of an upper portion 120 to which the support line 16*j* and the stabilization line 18*j* are attached, and a lower portion 122 which rotates relative to the upper portion. The upper portion and the lower portion are constructed of welded steel pieces and are connected with a swivel bolt 121. The swivel bolt 121 is used in coordination with an upper and lower set of beatings (not shown). This construction is standard and details are not shown.

The support line 16*j* and the stabilization line 18*j* connect the swivel horizontal support bar to the upright support structure (not shown). Except for the addition of the swivel horizontal support bar and the attachment of up to five riders instead of one, this alternate embodiment is identical to that shown in FIGS. 1–7. Although five riders are shown, fewer could ride. A larger version of the horizontal support bar could be made to accommodate more riders.

Skysaucer

Figure 11:
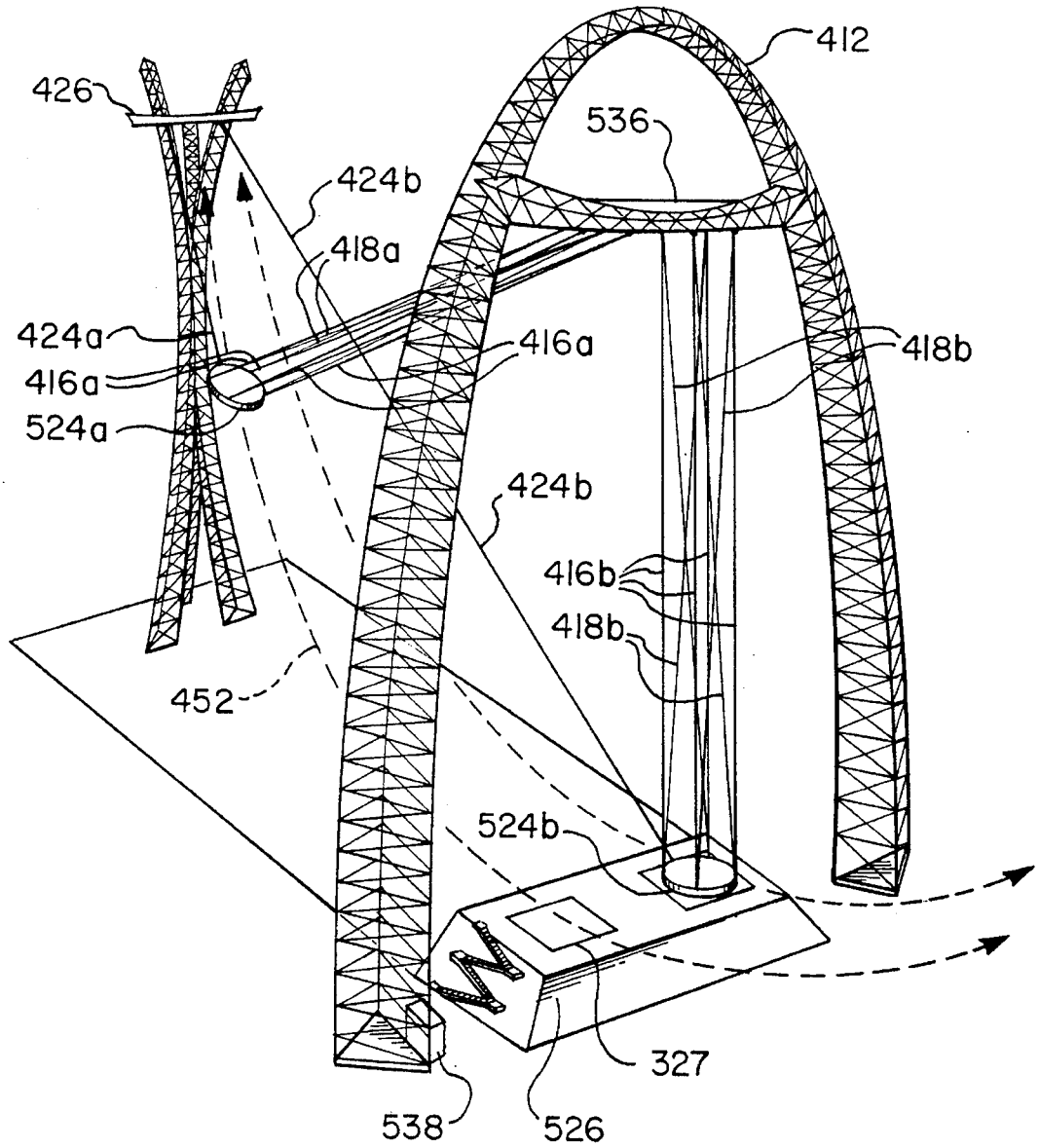
FIG. 11 is a to-scale perspective view illustrating the subject invention using a fixed tower as a support structure with a skysaucer suspended from support lines and stabilization lines and connected to a launch line.

Referring next to FIG. 11 an alternate embodiment allows many riders to enjoy the amusement ride together. This perspective view of the invention shows two independently suspended large conveyances (hereinafter referred to as skysaucers). The two skysaucers 524*a*, 524*b* are operated separately, but may be synchronized. Each skysaucer 524*a*, 524*b* accommodates about twenty people in this embodiment. Skysaucers 524*a*, 524*b* are equipped with seat belts and padded bars for restraint, similar to those used in a roller coaster amusement ride.

The skysaucer provides a more secure feeling to riders by including a solid conveyance. The higher speeds and increased elevation allow for enjoyment even for experienced riders of the single rider embodiment. The ability to provide rides to many people makes the amusement ride attractive to amusement park owners and operators. It is seen that all embodiments disclosed thus far form a spectrum of apparatus all capable of providing the feeling of free flight to each rider.

The skysaucers 524*a*, 524*b* are constructed of fiberglass with a steel structure. The skysaucers 524*a*, 524*b* in this embodiment are round and approximately eleven meters in diameter. The seats are arranged in two rows, forming concentric circles. Riders face the outward edge of the skysaucer. The inside circle of seats is elevated relative to the outside row so that no riders' view will be obstructed. Larger or smaller skysaucers could be built and different shapes could be employed.

An upright support structure 412 supports the skysaucers. In the embodiment shown, the support structure 412 forms an arch, and also includes an observation deck 536, reached via an elevator 538 which crawls up the side of the support structure 412.

The support structure 412 is approximately 400 feet high from the ground to the top of the arch. The width of the arch at the ground level is approximately 255 feet. The loading platform 526 is approximately twenty feet high and includes stairs. The observation deck is approximately 300 feet above the loading platform. Skysaucers 524*a* and 524*b* are approximately 34 feet apart and are each approximately 25 feet in diameter. The launch tower 426 is approximately 320 feet high, and is disposed approximately 300 feet from the support structure 412. The launch tower 426 includes two launch lines 424*a* and 424*b*. Each respective launch line 424*a* and 424*b* is removably attached to a skysaucer 524*a* and 524*b* at one end, and attached at the other end to a winch (not shown) inside the launch tower 426.

The skysaucer 524*a* is supported from the support structure 412 by a set of four support lines 416*a*. Additionally four stabilization lines 418*a* prevent sway and twisting of skysaucer 524*a*, and also serve as backup safety lines in the unlikely event of a failure of one of the support lines 416*a*. The support lines 416*a* and the stabilization lines 418*a* are each made of approximately 300 feet of aircraft quality stainless steel cable. An alternate design choice would be to employ two support lines rather than four, or only one support line, similar to the single rider embodiment. It is preferred that the number of stabilization lines be at least equal to the number of support lines, since the stabilization lines also act as a safety backup in the unlikely event of a support line failure. The skysaucer 524*b* is similarly supported by support lines 416*b* and stabilization lines 418*b*.

In operation of skysaucer 524*a*, riders embark from the loading platform 526. The launch line 424*a* is attached to the skysaucer 524*a*. The operation of the ride is controlled remotely by the ride operator. Once all riders are safely harnessed, the rider operator initiates the ride by having the launch line 424*a* pull the skysaucer 524*a* upward to near the top of the launch tower 426. The winch (not shown) contained within the launch tower 426 effects the lifting of the skysaucer 524*a*. Once the skysaucer 524*a* reaches a point near the top of launch tower 426, the ride operator brings the skysaucer 524*a* to a stop, maintaining an elevated position. The ride operator then launches the skysaucer 524*a* by detaching the skysaucer 524*a* from the launch line 424*a* via an electric solenoid release (not shown). The skysaucer 524*a* then begins to swing, assuming the path shown by dotted line 452, reaching speeds as high as 100 miles per hour. The ride continues for several minutes as the skysaucer 524*a* swings back and forth. The swing cycle height gradually decreases due to air friction and brakes on the braking platform 327 controlled by the ride operator.

The skysaucer 524*b* operates similarly to the skysaucer 524*a*, employing the launch line 424*b*, and a separate winch (not shown). Further operation details are disclosed below.

Skysaucer, Other

Figure 12:
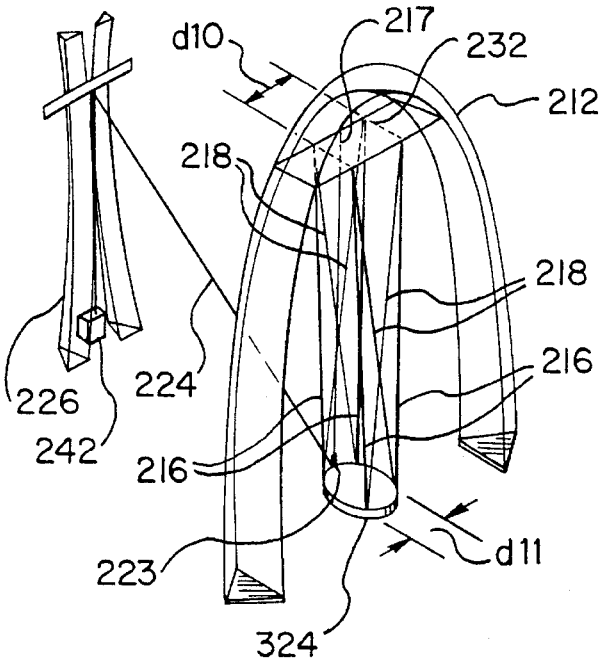
FIG. 12 is a diagrammatic isometric view illustrating the subject invention using a fixed tower as a support structure with a skysaucer suspended from support lines and stabilization lines and connected to a launch line.

Referring next to FIG. 12 an alternate embodiment of the twin skysaucer ride in FIG. 11 is shown. This view differs from FIG. 11 in that only a single skysaucer is shown, and the scale is different so that some construction can be detailed. Riders sit in the skysaucer 324, which is identical to that shown in the embodiment of FIG. 11.

An upright support structure 212 supports the skysaucer. The height of the support structure is more than one-hundred meters which provides for a maximum velocity of approximately one-hundred-fifty kilometers per hour. The launch structure 226 is approximately the same height as support structure 212. Most mobile cranes are not designed for the forces involved in a system this size, so a permanent structure is preferred.

The skysaucer 324 comprises the four support lines 216 and the four stabilization lines 218 which are each comprised of approximately one-hundred meters of aircraft-quality stainless-steel cable. An alternate design choice might employ two support lines, or a single support line, with at least one stabilization line.

Each of the tour skysaucer support fines 216 are substantially parallel. The distance d10 at the support line mechanism 232 is approximately fifteen meters. The distance d11 at the skysaucer 324 is approximately eight meters. Sway might otherwise be caused by wind or uneven loading, and thus is undesirable.

The skysaucer stabilization lines 218 are in a criss-cross configuration. The stabilization lines 218 prevent axial rotation of the skysaucer about the axis parallel to the support lines. The stabilization lines 218 also help eliminate sway and yaw, keeping the path of the skysaucer in the plane directly below the support-line mechanism 232. Path deviance and axial rotation could otherwise result from wind or uneven passenger weight distribution during launch. Without the stabilization lines 218 the support lines 216 would have to be spread very far apart to maintain a consistent path of motion. The stabilization lines 218 further act as safety backups in the unlikely event of a support line failure.

Skysaucer, Side View

Figure 13:
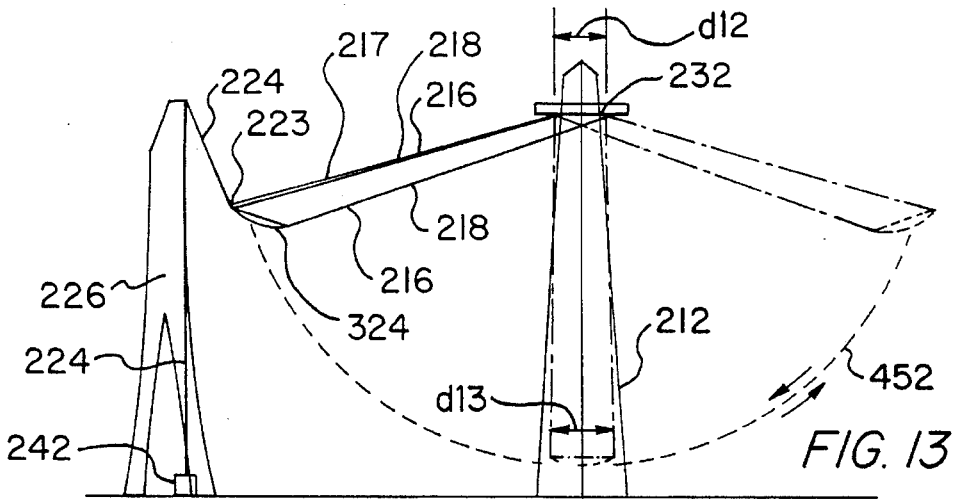
FIG. 13 is a side view of the skysaucer showing the orientation of the skysaucer at various path locations.

Referring next to FIG. 13 a side view of the skysaucer 324 of FIG. 12 in operation is shown. Due to the large height of the support structure 212 this figure is not to scale.

The distance d12 at the support line mechanism 232 is approximately five meters. The distance d13 at the skysaucer 324 is approximately eight meters. This configuration allows for the skysaucer 324 to be tilted at approximately forty-five degrees when in the launch position as shown. Configuring distance d12 equal to distance d13 would result in negligible tilt of the skysaucer 324 at the launch position and throughout the operational path. Configuring distance d12 smaller than distance d13 would result in a larger tilt angle at the launch position.

Skysaucer Loading Platform

Figure 14:
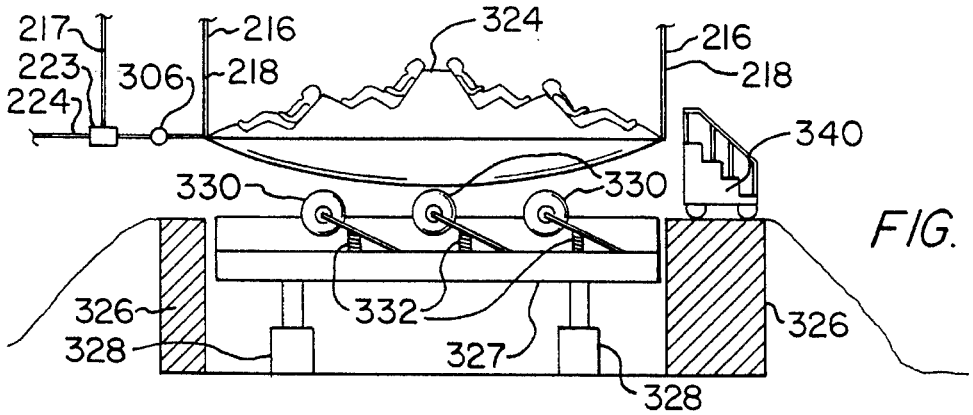
FIG. 14 is a side view of the skysaucer elevated loading conveyance showing the elevation means and the stopping means.

Referring next to FIG. 14 a side view of the elevated skysaucer loading platform 326 is shown. The operator controlled braking platform 327 is also shown. The loading platform 326 and surrounding base area 228 is elevated approximately seven meters. Typically the skysaucer amusement ride exists inside an amusement park, where ground space is very valuable. Raising the loading area allows other facilities to be located safely underneath the flight path of the skysaucer 324. If the flight path were not raised, much valuable ground space would be occupied by the flight path of the skysaucer, preventing the operation of amusement facilities such as hot dog vendors.

The braking platform 327 is moved upward into position by means of hydraulic lifts 328. During loading the braking platform 327 immobilizes the skysaucer 324. Mobile loading stairs 340 are moved into position for passenger loading and unloading. Once riders have loaded and are restrained securely, the loading stairs 340 are cleared out of the way and the braking platform 327 lowers. The braking platform 327 lowers about three to five meters, leaving the skysaucer unencumbered.

The braking platform 327 also contains within it a slowing means to slow and stop the skysaucer 324. The slowing means comprises brake-equipped rotatable tires 330, which are spring-loaded with springs 332 so as to gently yet firmly contact the skysaucer 324 during subsequent passes above the braking platform 327. The bottom of the skysaucer 324 has a smoothly curving surface such that tire contact occurs gradually rather than abruptly. Gradual contact and smooth slowing action is an important design criteria at one-hundred-fifty kilometers per hour. The tire contact area of the skysaucer 324 has a rough surface so as to enhance tire traction. In operation once the skysaucer 324 has passed freely over the landing platform several times, the braking platform 327 is slowly raised to a height such that the spring-loaded brake-equipped tires 330 contact the moving skysaucer 324 when it passes over the braking platform 327. The operator controls the braking platform height and the braking force.

One of the tires 330 also is powered with an electric motor to realign the skysaucer 324 for proper loading once the skysaucer 324 has been stopped. Realignment is detected with small switches or optional optical sensors which stop power to the motor once the skysaucer 324 is aligned correctly.

A launch weight 223 and launch weight line 217 are used, which serve to return the detachable end of launch line 224 to the starting point for reattachment to the skysaucer 324. The mechanism of use is analogous to the single rider embodiment, with the addition that launch weight 217 is much heavier to accommodate the heaviness of launch line 224. The skysaucer launch release 306 is activated remotely by the ride operator and employs an electrically activated solenoid. Following the skysaucer launch, the launch weight 223 and the skysaucer 324 become physically separated. The solenoid release remains attached to launch weight 223.

Skysaucer Rapid Loading Embodiment

Figure 15:
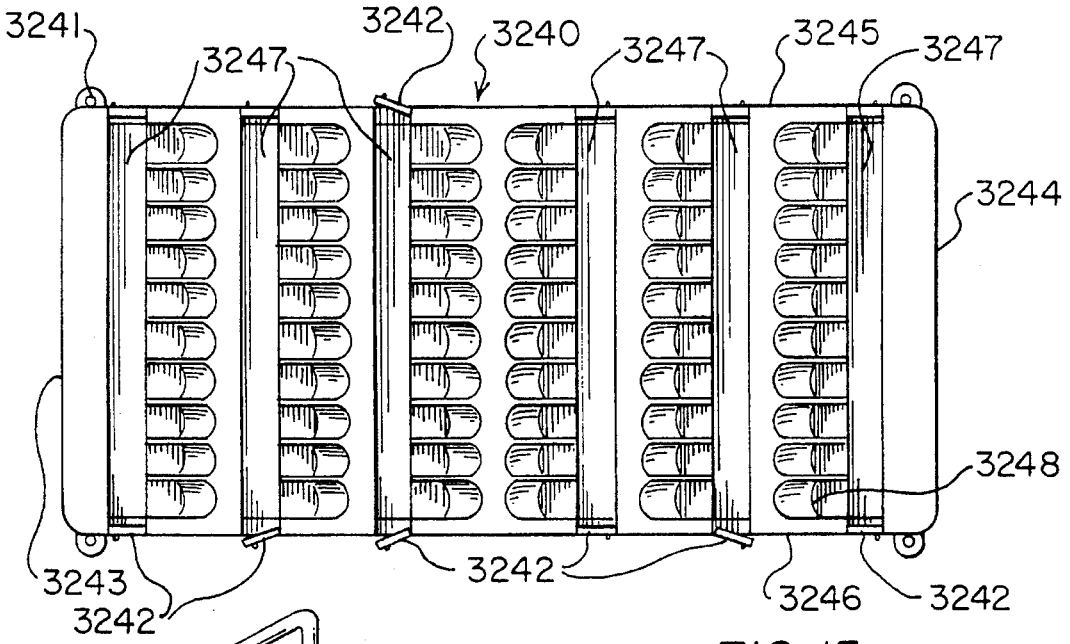
FIG. 15 is a top plan view of an alternate embodiment of a skysaucer having a rapid loading and egress walkway.
Figure 16:
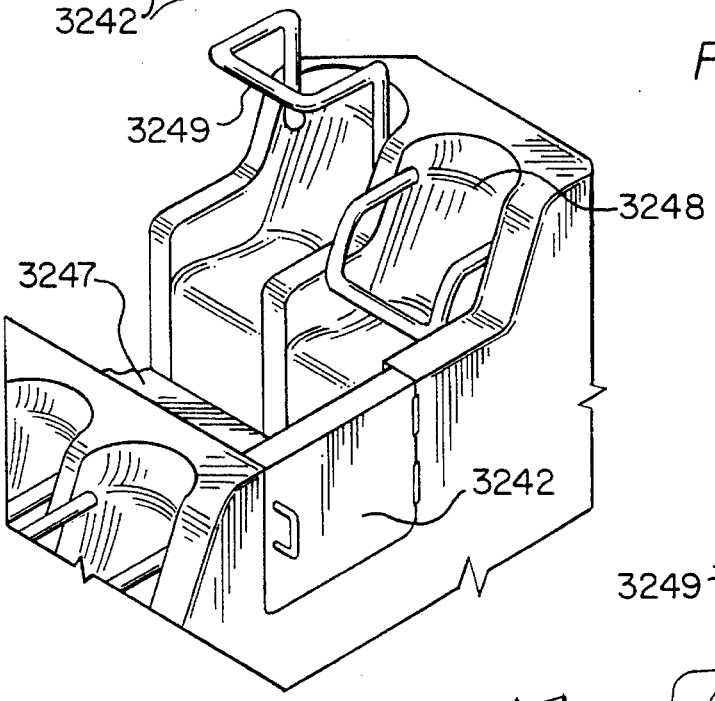
FIG. 16 is a top perspective view of a portion of the right side of the skysaucer of FIG. 15.
Figure 17:
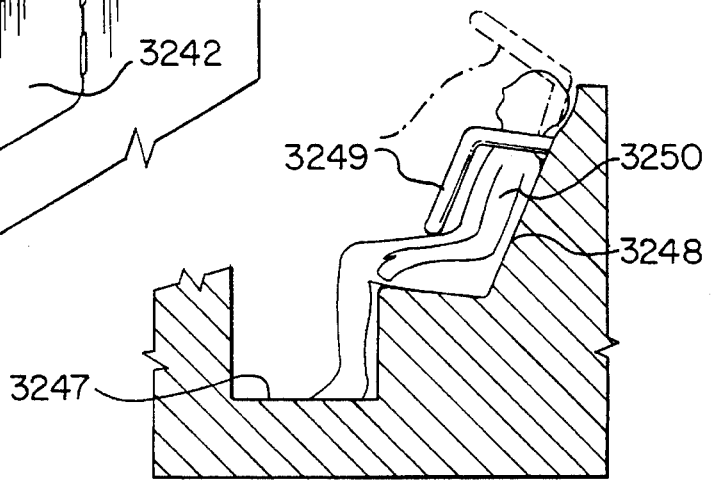
FIG. 17 is a right side plan view of the skysaucer of FIG. 16 with the door removed.

Referring next to FIGS. 15, 16, 17 a rapid loading/unloading embodiment of a skysaucer vehicle is denoted as numeral 3240. Skysaucer 3240 has symmetrical front and rear ends 3243, 3244, and left and right sides 3245, 3246 respectively.

The object of skysaucer 3240 is to load and unload sixty riders quickly. There exists a plurality of parallel rows of walkways 3247 for each ten seats 3248. All the seats 3248 are identical. Doors 3242 allow riders to file into and out of walkways 3247 in a rapid fashion. Once seated, the rider 3250 is secured by the body brace 3249 which has a load position (UP, FIG. 17) and a lock position (DOWN, FIG. 17). The doors have an internal locking mechanism (not shown) which is actuated in a known manner prior to lift-off.

Not shown is the ride operator console, which includes controls for raising the skysaucer (via lowering the braking platform and raising the attached launch line with the winch); launching the skysaucer (via activating the skysaucer launch release); lowering the launch weight (via the winch, possibly with the skysaucer attached); stopping the skysaucer (via raising the braking platform and applying braking force followed by skysaucer positioning). Safety controls also prevent operation during unsafe events, such as while the skysaucer is being loaded.

It is thus seen that, unlike the prior art, the present invention provides a swing type amusement ride which includes, in combination, a support structure having an upper portion which is located at least eleven meters (and as much as several hundred meters or more) above the surface of the ground, at least one support line having an upper end connected to the upper portion of the support structure and a lower end to which is connected a system for securing at least one rider support to the support line; as well as a launch structure which has an upper portion which is located at least eleven meters (and as much as several hundred meters or more) above the surface of the ground, is spaced from the upper portion of the support structure, and which carries a launch line which includes a launching mechanism for releasable attachment to the rider securing mechanism; and a mechanism associated with the launch structure, but which is not powered by any riders, which is capable of raising riders who have been properly secured to the system to a height of at least ten meters (and as much as several hundred meters or more) above the ground, from which height the rider may begin his or her swing away from the launch structure towards the ground in a curved trajectory to simulate the feeling of "body flight."

While the invention has been particularly shown, described and illustrated in detail with reference to preferred embodiments and modification thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. An amusement ride for raising at least one rider from the ground to a height of at least ten meters and releasing the rider to swing in a curved trajectory, the amusement ride comprising:

a support structure, said support structure extending upwardly to a height of at least eleven meters above the ground;

a rider support line having a first end and a second end, said first end of said support line being attached to the support structure, said support line being pivotally suspended in a normal position vertically downward from said support structure;

means for attaching said second end of said support line to a rider carried by said second end of said support line;

a launch structure; said launch structure extending upwardly to a height of at least eleven meters above the ground, said launch structure spaced from said support structure;

means for raising a rider at least ten meters above the ground from the lowest trajectory point, said means for raising a rider being associated with said launch structure; whereby, when the rider leaves said raising means the rider will swing freely on said support line;

said means for raising the rider further comprising a launch line having a first end and a second end, said first end of said launch line being attached to said launch structure, and there is provided means for attaching said second end of said launch line to the rider;

means for releasing the rider from said launch line are provided intermediate said means for attaching said second end of said launch line to the rider and said means for attaching said second end of said support line to the rider;

mechanical means for raising and lowering said launch line on said launch structure;

said means for attaching said second end of said launch line to the rider further comprising a launch weight line having a launch weight; and said launch weight line having a first end attached to said support structure and a second end attached to said second end of said launch line, functioning to provide a controlled lowering of the second end of the launch line to the lowest trajectory point.

2. An amusement ride for raising a plurality of riders from a static position at or near the ground to a height of at least ten meters, and releasing the riders to swing in a curved trajectory, the amusement ride comprising:

a support structure extending at least eleven meters from the ground;

a support line having a given length and a first end and a second end, said first end of said support line attached to said support structure, said second end of said support line attached to a multi-rider support means; said support line suspended from a normal position on said support structure vertically downward;

a launch means to raise the multi-rider support means in a curved trajectory defined by the support line;

a launch release means to launch the multi-rider support means in the curved trajectory;

the multi-rider support means further comprising an intermediary support member affixed to said second end of said support line; and an individual rider carriage means for each rider and individual coupling means for each carriage affixed to said intermediary support member.

3. The amusement ride of claim 2 wherein said intermediary support member further comprises a ring.

4. The amusement ride of claim 3 wherein said individual coupling means further comprise locking carabiners.

5. The amusement ride of claim 2 wherein said intermediary support member further comprises a horizontal support member having mounting means for said individual coupling means.

6. The amusement ride of claim 5 wherein said mounting means further comprise holes.

7. The amusement ride of claim 6 wherein said individual coupling means further comprise locking carabiners.

8. The amusement ride of claim 5 further comprising a swivel mount means supporting the horizontal support member.

9. The amusement ride of claim 8 wherein said mounting means further comprise holes.

10. The amusement ride of claim 9 wherein said individual coupling means further comprise locking carabiners.

11. An amusement ride for raising a conveyance holding riders from a static position at or near the ground to a height of at least ten meters, and releasing the conveyance to swing in a curved trajectory, the amusement ride comprising:

an upright support structure, said support structure extending at least eleven meters from the ground;

a conveyance support line assembly having a given length and first ends and second ends, said first ends of said conveyance support line assembly attached to said upper portion of said support structure, said second ends of said conveyance support line assembly attached to the conveyance, said conveyance support line assembly suspended from a normal position on said support structure vertically downward;

an upright launch structure extending upwardly from the ground and disposed from said support structure at a distance not greater than the length of said support line assembly;

a launch line having a first end and a second end, said first end of said launch line attached to means for raising and lowering said launch line on said launch structure, said second end releasably attached to said conveyance;

a movable loading structure having means a for lifting and lowering said movable loading structure, functioning to move said movable loading structure upward to a raised position to enable the riders to embark/disembark from the conveyance and to move said movable loading structure downward to allow the conveyance to swing in a curved trajectory; and said movable loading structure further comprises braking means for stopping said conveyance functioning to bring said braking means into contact with said conveyance when said movable loading structure is in the raised position.

12. An amusement ride for raising a conveyance holding riders from a static position at or near the ground to a height of at least ten meters, and releasing the conveyance to swing in a curved trajectory, the amusement ride comprising:

an upright support structure, said support structure extending at least eleven meters from the ground;

a conveyance support line assembly having a given length and first ends and second ends, said first ends of said conveyance support line assembly attached to said upper portion of said support structure, said second ends of said conveyance support line assembly attached to the conveyance, said conveyance support line assembly suspended from a normal position on said support structure vertically downward;

an upright launch structure extending upwardly from the ground and disposed from said support structure at a distance not greater than the length of said support line assembly;

a launch line having a first end and a second end, said first end of said launch line attached to means for raising and lowering said launch line on said launch structure, said second end releasably attached to said conveyance; and said launch line further comprises a launch weight line having a first and a second end and a launch weight functioning to enable the return of the second end of launch weight attached to said second end of said launch line, said first end of said launch weight line attached to said upper portion of said support structure, said second end of said launch weight line attached to said second end of said launch line.

13. An amusement ride for raising a conveyance holding riders from a static position at or near the ground to height of at least ten meters, and releasing the conveyance to swing in a curved trajectory, the amusement ride comprising:

an upright support structure, said support structure extending at least eleven meters from the ground;

a conveyance support line assembly having a given length and first ends and second ends, said first ends of said conveyance support line assembly attached to said upper portion of said support structure, said second ends of said conveyance support line assembly attached to the conveyance, said conveyance support line assembly suspended from a normal position on said support structure vertically downward;

an upright launch structure extending upwardly from the ground and disposed from said support structure at a distance not greater than the length of said support line assembly;

a launch line having a first end and a second end, said first end of said launch line attached to means for raising an lowering said launch line on said launch structure, said second end releasably attached to said conveyance;

said conveyance further comprises a plurality of access rows serving a plurality of seats, thereby enabling the rapid ongress and egress of riders;

a loading structure functioning to enable riders to embark/disembark from the conveyance; and a braking means functioning to stop the conveyance from swinging.

14. The amusement ride of claim 13, wherein said plurality of seats each has a retractable locking means functioning to secure the rider during flight.

15. The amusement ride of claim 13, further comprising lockable doors for each access row.

16. The amusement ride of claim 13, wherein said braking means further comprises wheels on the loading structure brushing against the conveyance.

* * * * *